US006908066B2

(12) United States Patent
Koenig

(10) Patent No.: US 6,908,066 B2
(45) Date of Patent: Jun. 21, 2005

(54) METHOD AND APPARATUS FOR AUTOMATIC AND SEMI-AUTOMATIC CONTROL OF TRACK-GUIDED TOYS AND MODEL VEHICLES

(75) Inventor: Andreas Koenig, Salzburg (AT)

(73) Assignee: Peter Maegdefrau, Freilassing (DE)

( * ) Notice: Subject to any disclaimer, the term of this patent is extended or adjusted under 35 U.S.C. 154(b) by 0 days.

(21) Appl. No.: 10/258,573

(22) PCT Filed: May 4, 2001

(86) PCT No.: PCT/EP01/05038

§ 371 (c)(1),
(2), (4) Date: Feb. 5, 2003

(87) PCT Pub. No.: WO01/87444

PCT Pub. Date: Nov. 22, 2001

(65) Prior Publication Data

US 2003/0148698 A1 Aug. 7, 2003

(30) Foreign Application Priority Data

May 5, 2000 (DE) ..... 100 21 927

(51) Int. Cl.[7] ..... B61L 23/34
(52) U.S. Cl. ..... 246/122 A
(58) Field of Search ..... 246/122 R, 123, 246/122 A, 167 R, 20, 21, 27, 28 R, 34 R; 104/DIG. 1

(56) References Cited

U.S. PATENT DOCUMENTS 6,402,094 B1 * 6/2002 Beer ..... 246/122 R
6,456,937 B1 * 9/2002 Doner et al. ..... 701/213
6,513,763 B1 * 2/2003 Ireland ..... 246/122 R
6,533,223 B1 * 3/2003 Ireland ..... 246/122 A
6,693,562 B2 * 2/2004 Rostren ..... 340/988

FOREIGN PATENT DOCUMENTS

| | | |
|---|---|---|
| DE | 44 45 640 | 6/1995 |
| DE | 196 22 132 | 12/1997 |
| DE | 196 04 154 | 2/1998 |
| DE | 197 04 766 | 8/1998 |
| DE | 199 38 909 | 3/2000 |

* cited by examiner

*Primary Examiner*—S. Joseph Morano
*Assistant Examiner*—Robert J. McCarry, Jr.
(74) *Attorney, Agent, or Firm*—Oblon, Spivak, McClelland, Maier & Neustadt, P.C.

(57) ABSTRACT

A method and an arrangement for the accurate, realistic automatic or semiautomatic control of track-guided toys, in particular electrically operated model railways and trains. Type- and/or geometry-specifying memory components, readable by non-contact, are disposed at or in each track, track piece, buffer, signal and/or switch that is to be included in the structure, such that each memory component and hence each track in addition exhibits an identification code that is not repeated within the series of such codes. Furthermore the rolling stock, preferably the locomotives, are equipped with a memory-reading device as well as a data-transmission device for revertive communication. After a first trip around the route, an electronic representation of the route configuration is available and can be preserved in a central memory. During subsequent trips around the route, the momentary position on the roadway or of the train is determined by reading memory components and revertive signalling to the central memory or a central control system, such that on the basis of prespecifiable tasks associated with operation of the railway, taking into account the route and velocity information as well as special functions, one or more machines are independently monitored and controlled.

48 Claims, 6 Drawing Sheets

METHOD AND APPARATUS FOR AUTOMATIC AND SEMI-AUTOMATIC CONTROL OF TRACK-GUIDED TOYS AND MODEL VEHICLES

BACKGROUND OF THE INVENTION

1. Field of the Invention

The invention relates to a method for the automatic or semiautomatic control of track-guided toys, in particular electric models of railways and trains, that is realistic and true to the original, as well as to an arrangement for implementing such a method. The invention further proposes tracks, pieces of track or switches for use with an automatic method of controlling model railways and trains, as well as rolling stock, in paticular locomotives, for the same purpose. In addition, the invention relates to a method of controlling a toy with at least one toy vehicle that can be caused to travel along a roadway while being guided by tracks, as well as a method of determining the position of a toy vehicle and/or of obtaining a representation of the course of a roadway with at least one toy vehicle that can be caused to travel along a roadway while being guided by tracks. The invention also proposes arrangements for the realistic automatic or semiautomatic control of track-guided toy vehicles and roadway components for track-guided toy vehicles as well as toy vehicles that can be used for the purpose.

2. Discussion of the Background

Digital model-railway control systems have been state-of-the-art for several years. In such control systems the full driving voltage, e.g. 16 V, is continually applied to the track. The rails serve simultaneously to transmit digital data, forming a so-called data bus.

For this purpose, appropriate digital control commands are superimposed on the driving voltage. These digital control commands are encoded by a control system in a digital transmission format, e.g. NMRA/DCC, and are decoded in the particular model. For this decoding each locomotive comprises a so-called "locdecoder", which sends out signals specifying direction, velocity and ancillary functions, such as activation of lights or automatic coupling, that correspond to the user's commands. Such decoders can also be used in other functional articles such as cranes, switches or the like, for the remote triggering of control commands.

The advantage of digital systems resides in the fact that all control commands can be transmitted through the track. Accordingly, the entire installation, with locomotives, functional models and switches, can be operated by way of a double-pole connecting cable. The elaborate cable arrangements that are a conventional part of the analog technology are eliminated.

Because the individual decoders can be targeted by way of a freely programmable address, several locomotives can be driven and also arbitrarily turned off entirely independently of one another, on a single circuit. Track-separation sites are no longer needed.

Hence the digital technology presented here offers substantial advantages both in setting up the installation and also while playing, but as yet there are no systems adequate to meet practical demands and economical in construction that would make possible detection of the position of the rolling stock, i.e. the trains, on the roadway. However, it is only when the exact positions of the vehicles and their current velocities are known that an action control is possible, e.g. sending out specific stop commands, maintaining predetermined velocities, specification of particular routes and so on. Ultimately, above all in the case of large installations, monitoring of the train operation with detection or assignment of actual positions is extremely important, so that functional impairments can be identified and possible collisions avoided during operation of the model railway.

SUMMARY OF THE INVENTION

It follows from the preceding that the objective of the invention is to disclose a method and an arrangement for the automatic or semiautomatic control of track-guided toys, in particular electrically powered model railways and trains, that are as realistic and true to the original as possible, that provide economical means of allowing the position of the rolling stock to be detected exactly, and that make it possible for a representation of the route or track to be recorded by simple means while the route itself is being travelled, as well as to transmit these data to a central memory for the execution of control and monitoring tasks, so that once an installation has been set up, elaborate manual route monitoring is eliminated.

Another aspect of the invention is that a track, track piece, switch or the like is disclosed for use with the cited method, as well as suitable rolling stock.

The objective of the invention is achieved with respect to the method by the teaching according to Claim 1, and with respect to the arrangement by the means given in Claim 10.

With respect to the tracks, track pieces, switches or the like that are suitable for use with the method in accordance with the invention, reference is made to Claim 11, and with respect to the rolling stock, to Claim 15.

The subordinate claims comprise at least advantageous embodiments and further developments of the invention.

The basic idea underlying the invention, as set forth in the claims, resides in achieving a detection and feedback of the momentary position of the rolling stock on route so that by way of the feedback possibility thus provided, a realistic running operation is possible, such that in addition to the position the absolute model velocity is also determined, which enables a number of features: for example, precise stopping in front of signals as well as control of velocity limits by way of signals or prescribed by a central controller, the actions of stationary trains in front of signals, such as emitting indicator lights and sounds, and also waiting times at the cleared exit signal.

Running operation designed in this way, such that the exact position is monitored with precision in the decimeter range, also prevents encounters involving flanking, intersecting or frontal travel, with correspondingly high safety during play.

As a result of the teaching in accordance with the invention, the advantages of an existing digital control system can be raised to a substantially higher utilization level; examples include the programming of individual and place-related sojourn times, an automatic digital block-signal-post operation, the positioning of three-dimensional images of the locomotive and the train on a display, in the sense of a virtual model railway, and other facilities.

In one conceivable embodiment of the invention the controlling software can be transmitted by way of a public network, e.g. the internet, so as to enable even quasi remote-controlled playing by several users, who are seated at widely separated sites and observe the progress of the game, e.g., by a webcam.

Because the method in accordance with the invention together with the associated arrangement provides an exact representation of the track, including e.g. the position of buffers, and positions can be determined with the required precision, a shunting operation in which trains are arranged in a particular sequence can be implemented, just as a locomotive can be caused to stop exactly when desired, e.g. before striking a buffer.

The positions of the vehicles, i.e. of the rolling stock, and their functional states can be detected and represented on an operator's display, which can be designed, e.g., as a touch screen.

With respect to increasing operating safety, moreover, it is possible in case of critical functional states to display warning messages that include positional information, so that the user and operator of the installation can react immediately and intervene appropriately. With reference to a record of time and place, an associated control program can be used to undertake a stepwise reduction or adjustment of the train velocity in sections where braking or velocity limitation is followed by acceleration, in the sense of intelligent braking or intelligent train operation, respectively.

Playing with the installation is also made very interesting when the user is given a means to impose temporary speed limits at construction sites along the route, or also to prescribe maximal speeds for each train, for instance to distinguish freight train, passenger train, express train etc. An especially interesting aspect is the possibility of digitally controlled parallel exits for multiple trains, with suitably adjusted velocity.

The monitoring of time and position thus enables a real train operation according to a schedule appropriate for a model railway.

In accordance with the invention each track, piece of track or switch, as well as selected buildings and other installation components, is connected to a memory unit with non-contact readout, in particular a transponder. In this memory unit or transponder are stored data specifying type and/or geometry as well as an identification code that uniquely specifies each track.

The rolling stock is equipped with a memory-reading device as well as a data-transmission means for revertive communication of the items of information that have been read out and, where necessary, decoded.

The memory-reading device is capable of receiving the data from the identification element, e.g. the transponder, by non-contact means. The transponder preferably employed is a microelectronic circuit with a transmitting and receiving antenna, control logic and storage for data and energy. This transponder can be incorporated as a complete unit, by injection, e.g., into the track ballast or a holding device or connection to the associated track or piece of track elsewhere, during the manufacturing process.

It is in accordance with the invention for the manufacturer to employ permanently programmed transponders, but the possibility also exists to use transponders that allow the stored information to be overwritten by means of a special programming device.

The transponders preferably derive the energy needed for the transmission of information from the electromagnetic field created when the memory-reading device is connected to or brought into the vicinity of the transponder. In this situation the writing/reading antenna of the memory-reading device has come within the range of the transponder, so that the first event is charging of the available energy storage means, e.g. a capacitor. Then the transponder transmits the contents of a data memory, i.e. the type- and/or geometry-specifying information regarding the particular track, including the individual identification code, to the memory-reading device. The dialog or data transmission is repeated cyclically as long as the transponder and memory-reading device are within transmission range of one another; in this process data security during transmission is ensured by a prescribed data protocol.

After an installation comprising the special tracks, track pieces and/or switches, as well as the memory components with non-contact readability, has been completed or appropriately reconfigured, the entire route is travelled for the first time with rolling stock of the kind described above, i.e. having at least one memory-reading device. During this initial circuit the track configuration is "scanned" and the result is entered into a superordinate control system by way of the data-transmission means. This is made possible by the individual identification (length and type of track) and the specified geometry of each track or piece of track. In this way the control system and the control software it contains receive an exact electronic representation of the installation with all its elements—including, e.g., signals, switches and buffers, which can also be equipped with transponders. That is, the electronic system would be capable of operating the trains on its own.

In the case of relatively large installations with extremely high requirements for precision and/or resolution, it is further possible to provide a specific, geometrically exactly determined reference point, which can be used for initial measurements so that during subsequent operation the position obtained by computer calculation from the individual measurements can be calibrated when transiting or approaching the reference point.

A supplementary sensor, e.g. a magnetic-field sensor, which can be integrated into the rolling stock, makes it possible to measure directional changes, in particular during the initial traveling and scanning-in of the route and generation of the track image, so that the route can be recorded in a shorter time and with less elaborate calculation.

A similar supplementary sensor system is able to detect changes in the vertical orientation of the route, e.g. downward or upward gradients, so as to have command over installations constructed in more than one plane. For example, it is useful here to have an electronic slope sensor which, at prespecifiable time intervals or when specific thresholds are passed, causes direction-change information to be sent by way of the data-transmission means in the track-bound drivable machine, i.e. the locomotive.

In one embodiment of the invention memory-reading devices and data-transmission means are provided not only in the drivable machines, i.e. the locomotives, but also in the attached carriages, so that an automatic shunting is possible, e.g. to assemble trains comprising tank cars, flat cars and so on.

The data transmission, i.e. the revertive communication, can be accomplished either by way of the two-wire bus, e.g. in NMRA-DCC format, or by wireless means; it is important here to ensure real-time capability while taking into account the actual model-railway velocities.

In accordance with the method it is then possible, by means of the system controller with the use of a personal computer and its control software, to assign to selected tracks, signals, switches and/or route sections special functions, so that the operation of the system closely resembles that of a real railway. Such special functions can include, e.g., right-of-way indications, speed requirements, start/stop commands, braking and/or acceleration tasks and the like.

While a train is traveling the route, the sequential activation of and readout from the memory components, in particular transponders, with utilization of the route diagram or other representation deposited in the central memory, provides a coninuous determination of the position of the train on the railway by signals sent back to the central memory; in this process, with reference to prespecifiable tasks for operating the railway while taking into account the route and velocity information as well as the special functions, one or more machines are automatically monitored and controlled.

In the arrangement in accordance with the invention for the automatic or semiautomatic control of track-guided toys such as electric model railways and trains that is realistic and true to the original, the basic equipment consists of at least one memory unit with non-contact readout that is situated in or at the track, piece of track, buffer, signal and/or switch, such that the content deposited in the memory part of the memory unit specifies the type of product in each case plus a unique individual identifier. The type specification in the case of a track or track piece concerns, e.g., the length, the curve radius, the branching radius or angle in the case of switches, and the radius of the trunk track and that of the branch track in the case of curved switches.

The arrangement further comprises at least one memory-reading device in the model rolling stock, in particular the electrical machine, which additionally possesses a date-transmission means to pass the collected contents on when the machine reaches or travels over the memory unit.

The arrangement comprises in addition a superordinate central control and memory unit to determine position and velocity with reference to a detected or prespecified track diagram. As memory units transponders are preferentially employed, as mentioned above, and these can for instance be disposed in the track bed or connected in some other way so that they cannot be removed without destroying the above-mentioned products. The individual identifier deposited in the transponder consists of a sequence of numeric or alphanumeric symbols that is not repeated within the series of such sequences.

The rolling stock, in particular locomotive, comprises in accordance with the invention an electronic unit for activating and scanning transponder contents as well as a decoder and the above-mentioned data-transmission means. The latter is connected to the decoder, to which the scanned-in transponder contents are sent, the data-transmission means being designed as a hard-wired or wireless interface.

In addition, the rolling stock can contain a sensor to detect changes in the movement of the locomotive in the vertical and/or horizontal direction.

Another objective of the invention is to create and disclose a method, and components that can be employed therewith, that makes available to a user a plurality of possibilities with which to enhance the attractiveness of playing.

This objective of the invention is achieved by the characteristics given in Claim 19.

One advantage derived from the characteristics cited in this claim resides in the fact that they enable partially or fully automatic control of track-guided toy vehicles on a model installation. The positional information provided with this method, i.e. the ability to observe events during operation of the toy, by which is meant the roadway and/or the toy vehicle as such, simultaneously permits these events to be visualized on a commercially available calculator unit, in particular a personal computer. In addition to these possibilities for observation/visualization, it is of course also possible on the basis of the evaluation unit, preferably designed as a personal computer, to undertake active intervention in or influencing of such events.

The objective of the invention is also independently achieved by the characteristics given in Claim 20.

The advantages derived from the combination of characteristics in this claim reside in the fact that they enable an almost completely automatic collection of data for the representation of a roadway system with any desired structure, by simply traveling over the entire route network. The information that is read can be transmitted by simple means to a central evaluation apparatus and used by the latter for highly diverse processing, in particular to generate a virtual image of the installation.

A further development according to Claim 21 is advantageous in this regard, because it enables the data collection for representation of a route system to be undertaken almost entirely independently of user activities. Furthermore, the momentary position of the toy vehicle can be determined at any time.

As a result of the optional measures specified in Claim 22, the precision can be increased and/or errors in the control or observation processes can be corrected.

By means of the measures according to Claim 23 and/or 24, the visualization of roadway images, functional states and toy vehicles can be matched to the users particular desires or requirements.

The additional measures given in Claim 25 allow actions that enliven play, such as information broadcasting, light signals, traffic-direction signs and the like, to be activated.

By means of the measures according to Claim 26 a course of events resembling that in real traffic systems can be implemented by specifications in the form of timetables.

The objective of the invention is also and independently achieved by the characteristics given in Claim 27.

The advantages derived from the combination of characteristics in this claim reside in the fact that without elaborate hardware or technology, in particular without complicated cable arrangements, a highly developed control and/or observation of toys, in particular toy vehicles guided by tracks on roadways, is made possible.

An independent way to achieve the objective of the invention is also specified by the characteristics given in Claim 28.

The advantages derived from the combination of characteristics in this claim reside in the fact that the identification-code carriers, which are needed in relatively large numbers, are assigned to the relatively numerous railway components, which allows the overall costs of the system in accordance with the invention to be kept low. Moreover, the provision of a device to measure distances along the route makes possible a higher-resolution determination of position.

An independent way to achieve the objective of the invention is specified by the characteristics according to Claim 29.

The advantages derived from the combination of characteristics in this claim reside in the fact that they create an economical basis for the automated control and observation of sequences of events in the course of play. Given that the identification-code carriers need merely to identify the type of a railway component, standardized code carriers that are relatively inexpensive to obtain can be employed. Because the amounts of data are comparatively small, code carriers with little storage capacity can be used. The individual identifier can then serve quasi as a pointer to more extensive data blocks or data sets, containing for example geometric data.

The further development according to Claim 30 achieves great flexibility in the assignment of functions or actions to particular roadway sections.

With the embodiment according to Claim 31, mistakes by the user in connecting identification-code carriers to particular roadway components are excluded.

The characteristics according to Claim 32 make it possible to determine the relative position of a toy vehicle with reference to the roadway component.

By means of the measures given in Claim 33 a high degree of security against interference and transmission reliability of the type-specific identifiers is achieved.

The geometry of a complex route network can be determined with computer assistance for an evaluation device by associating the geometric data with the identifiers.

In the embodiment according to Claim 35 it is advantageous that such identifiers can be reliably detected with standard sensing systems.

In the embodiment according to Claim 36 it is advantageous that the code carriers need not be provided with an independent energy supply, but rather are designed as passive electronic components.

In the possible embodiment according to Claim 37 or 38 it is advantageous that the codes can be detected reliably even in the presence of severe interference from electromagnetic fields.

In the further development according to Claim 39 or 40 it is advantageous that the direction of a toy vehicle relative to the roadway route can be determined with reference to a single roadway component.

The objective of the invention is also independently achieved by the characteristics given in Claim 41.

The advantages provided by the characteristics in this claim reside in the fact that a reading device with associated data-transmission means suffices to determine a position.

In the further development according to Claim 42 or 43 it is advantageous that extraneous influencing of the reading device by adjacent identification-code carriers can be avoided by simple means.

Provision of a cable system to constitute a means of data transmission from the toy vehicle to the evaluation unit that controls its activities is made unnecessary by the embodiment according to Claim 44.

The measures according to Claim 45 make it possible by simple means to implement uni- or bidirectional transmission between the toy vehicle and an evaluation unit.

By means of the optional further development according to Claim 46 or 47, supplementary items of information related, e.g., to height differences or changes of direction can be obtained.

Finally, a possible further development according to Claim 48 is advantageous because it enables the correction of errors and/or a high-resolution determination of position.

In the following the invention is explained with reference to exemplary embodiments, the description of which is assisted by drawings.

These figures represent the principles underlying the installation of transponders in or at the track, and illustrate the approach of a locomotive to a transponder. In simplified drawings,

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
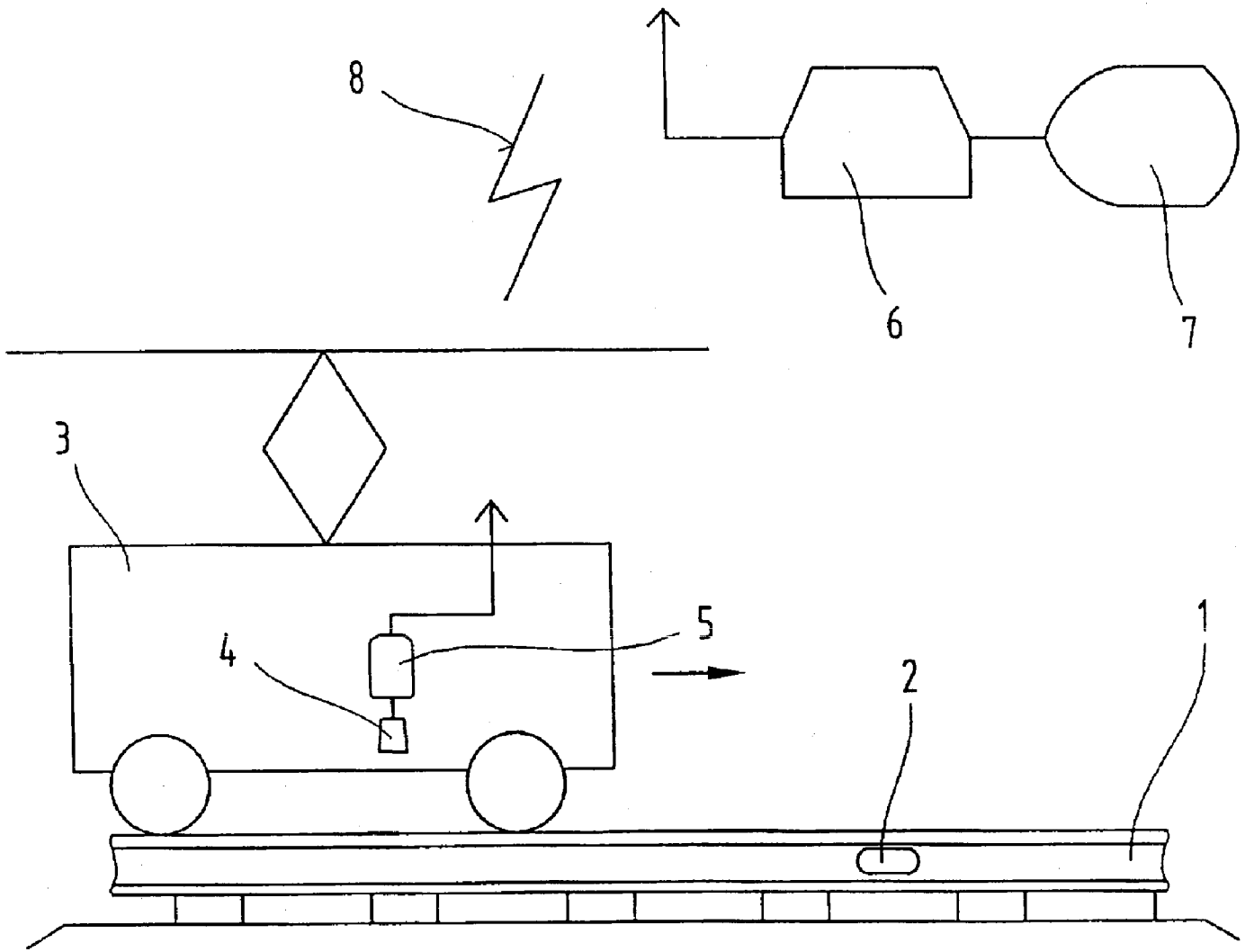
FIG. 1 shows in principle how a transponder is mounted in or at the track, as well as a locomotive approaching the transponder.

Referring now to the drawings, wherein like references numerals designate identical or corresponding parts throughout the several views.

In or at the track 1 there is a transponder 2 that specifies the track's type and geometry, having been disposed in the relevant track section or on the track or during manufacture fixedly connected thereto, e.g. injected into the ballast or integrated into part of the track bed. The transponder 2 comprises, in addition to the type- and geometry-specifying data, an individual identifying code which is not repeated.

The locomotive 3 possesses a memory-reading device with antenna 4 and a data-transmission means 5. The data-transmission means 5 creates a wireless connection to a receiver 6 and a central memory, which can be a component in a personal computer. On a monitor 7 a representation of the track is displayed, and the momentary position of each element of rolling stock on the route can be indicated there.

At the moment when the locomotive 3 comes within the transmission range of the transponder 2, the high-frequency field generated by radiation from the antenna 4 excites the receiving antenna integrated into the transponder 2, so that in a next step data can be read out from the transponder 2 and collected by the antenna 4 of the memory-reading device. The data and information thus obtained are then passed on, by way of a wireless transmission path, to the receiver 6, which by referring to the known route details is capable of determining the position and velocity of the locomotive, and hence of the train.

The type- and geometry-specifying data stored in the transponder can be derived, for example, from the article-identification code associated with the track or piece of track, the individual identification code being a serial number assigned only once, so that each track piece that reaches the end user is uniquely identified and its geometry is specified.

In the exemplary embodiment shown here a wireless transmission path is assumed, but it is also possible to make use of a digital two-wire bus system, which is available in any case, to transmit this return signal.

Additional transponders can also be integrated into signals, switches or other equipment for operating the railway, so that when the train reaches such equipment, special functions are initiated, or a specified controlling or switching action is begun, or the equipment is tested for functionality.

On the whole, with the invention just described it is possible to create a real running operation for a model railway, in which it is possible to detect the position of the rolling stock with high precision. Owing to the properties of passive transponders no elaborate modifications are needed, nor is a supplementary electricity supply required at the track for the memory components disposed there, so that the equipment costs can be kept within limits. Maximally miniaturized encapsulated transponders have a diameter of about 2 mm and a length of ca. 10 mm, with a weight of about 0.1 to 0.25 g. The maximum distance at which transponders currently on the market can be read is in the region of 200 to 400 mm, which is sufficient for the application cases of interest here.

It should be kept in mind that in the following presentation of various embodiments identical parts are given the same component names and reference numerals, and accordingly what has been said in this description also applies below to the same parts, with the same names and reference numerals. Furthermore, in the following descriptions the details regarding position—such as above, below, at the side etc.—refer to the figure and represented structure that are currently being described, and when the orientation of the structure changes, such terms should be transferred appropriately to the new orientation. Individual features or combinations of features in these exemplary embodiments can represent solutions that are independent, inventive or in accordance with the invention.

Figure 2:
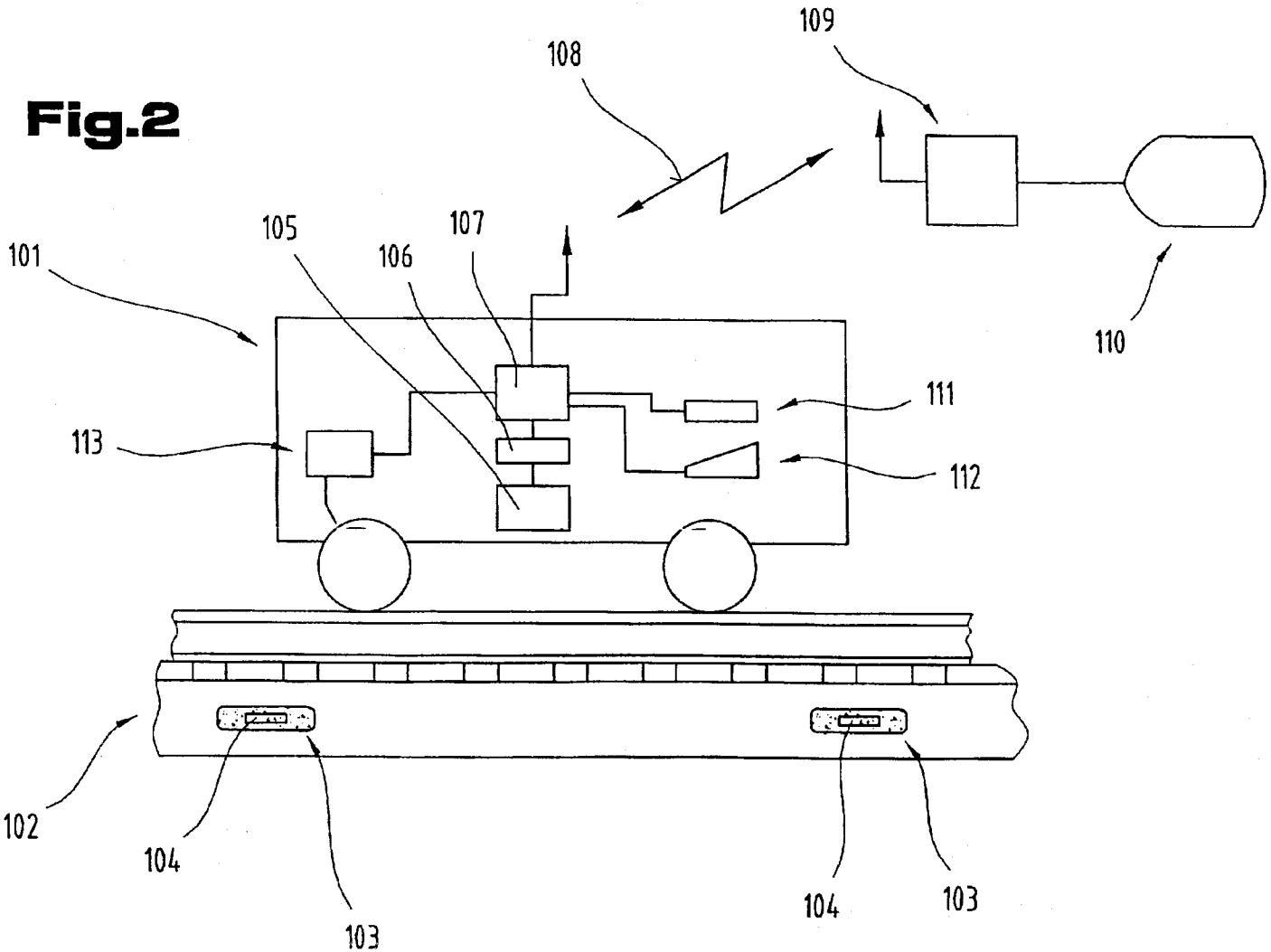
FIG. 2 shows in principle the components required for the method in accordance with the invention for controlling a track-guided toy.

FIG. 2 shows in principle the components that are essential for implementing the method in accordance with the invention for controlling a track-guided toy.

A toy vehicle 101 is situated on a roadway component 102 that forms a piece of a roadway; to this component are attached identification-code carriers 103 that are provided with an identifier 104 or that in themselves constitute an unmistakable, unique identifier. So that the identifiers 104 can be detected, the toy vehicle 101 is equipped with a reading device 105, the identification-code carriers 103 being readable by non-contact means. The signals from the reading device 105 that correspond to the identifier 104 are sent to a data-transmission means 107 by way of a decoder 106 and pass from there along a transmission path 108 into an evaluation unit 109. The transmission path 108 can either consist of a wire connection or be wireless. For the case of model railways a hard-wired system, e.g. by way of the rails of the track, is possible. When the transmission path 108 is designed to be wireless, the data exchange between the data-transmission means 107 and the evaluation unit 109 is accomplished, e.g., by radio with the assistance of corresponding antennae. The evaluation unit 109 can take several forms, e.g. comprising control software in a personal computer, in which case the information can be displayed on a monitor 110. The toy vehicle 101 can optionally be equipped with a direction sensor 111 to detect directional changes, as well as a slope sensor 112 and a distance-measuring device 113 with which to determine the length of the part of the roadway over which the train has travelled. The data provided by the slope sensor 112 and the distance-measuring device 113 can be processed by the evaluation unit 109 so as also to determine the vertical position or height of the toy vehicle 101, especially for roadways constructed at several different levels.

In the identification-code carriers 103 of a roadway component 102 are stored at least the type data for the component 102. Different types of roadway components 102 would be, e.g., straight segments, branch points such as switches, intersections, or curved segments and similar components. The identifier 104 of a given type of roadway component is encoded by a sequence of numerical or alphanumeric symbols that is not repeated within the series of such sequences.

The identification-code carriers 103 are preferably transponders designed as passive electronic components. By means of a high-frequency field generated by an antenna of the reading device 105 the transponder is triggered to send out the identifier 104, which can thus be detected by the reading device 105. The identifier 104 in this case takes the form of an electrically or magnetically detectable feature. The transponder constructed as identification-code carrier 103 incorporates a transmitting and receiving antenna, control logic and a means of data and energy storage, but it need not have its own, autonomous electricity supply. The energy derived from the electromagnetic field of the transmission antenna in the reading device 105 suffices as electrical operating energy for the transponder.

As required by the small distances between the roadway components 102 of toys, the distances between the identification-code carriers 103 implemented as transponders are also relatively slight, so that in principle there is a risk that a reading device 105 will read out information from several identification-code carriers 103 simultaneously. To prevent this, the reading device 105 is constructed with a limited spatial range for reading from the identification-code carriers 103. This can be accomplished by appropriately reducing the transmission power of the transmission antenna of the reading device 105. In accordance with the size relationships customarily prevailing in model railways, the spatial range can be restricted to a distance between 0 mm and 50 mm, or preferably 0 mm to 30 mm.

It is of course also possible to construct systems comprising identification-code carriers 103 and reading devices 105 such that an identifier 104 is implemented by other features. For instance, the identification-code carrier 103 could be imprinted with a bar code, in particular a bar code that is visible only under UV light. A corresponding reading device 105 could in this case take the form of a bar-code scanner. In another embodiment of the invention it is also possible to use a reading device 105 designed for ultrasound sampling to identify the roadway component 102. In this case the component 102 itself is the identification-code carrier, in that its external shape is used for identification.

Figure 3:
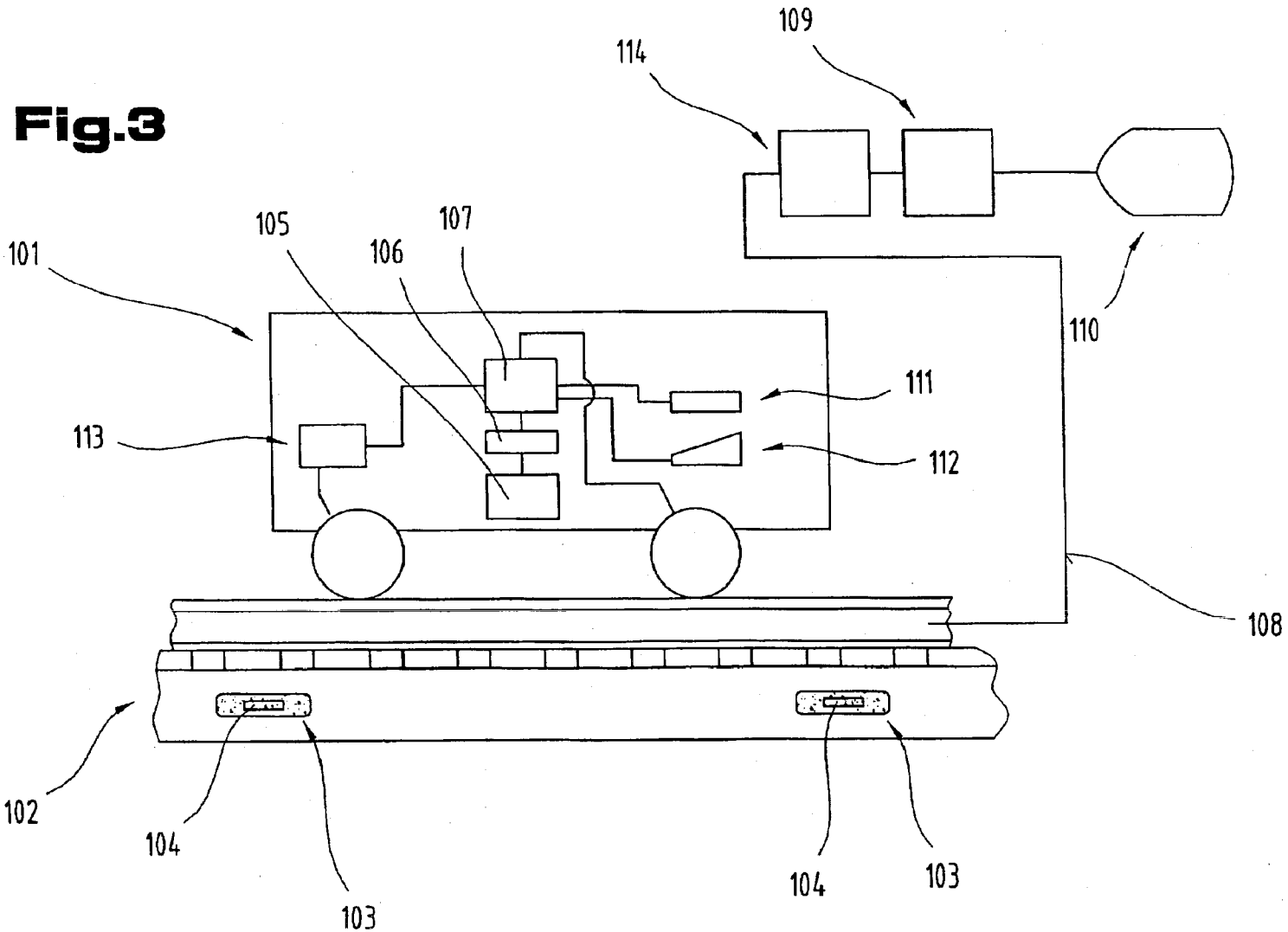
FIG. 3 shows another exemplary embodiment of the arrangement of the components essential for the method in accordance with the invention.

FIG. 3 shows another exemplary embodiment of the arrangement of components essential for the method in accordance with the invention. Here the toy vehicle 101 moves on a roadway component 102 configured as a track, as is customary e.g. for model railways. The rails of the track can be used to supply the toy vehicle with the running voltage needed to drive the motor, but they can also be used for exchanging signals between the toy vehicle 101 and the evaluation unit 109. The signals from the data-transmission means 107 in this case pass through the wheels of the toy vehicle 101 and the rails of the roadway component 102 and then in sequence along the transmission path 108 to the signal converter 114. The signal converter 114 serves to convert the signals into a format that can be processed by the evaluation unit 109 and send them on to the evaluation unit. The signal converter 114 can be designed as an independent component or, if desired, as an interface card built into a personal computer. The transmission path 108 along which the signals pass between the rails of the roadway component 102 and the signal converter 114 can of course be either wireless or a wired connection.

FIGS. 4 to 7 show various arrangements of identification-code carriers 103 in a roadway component 102 such as is used for model railways. Here a roadway component 102 consists of a track 120 comprising rails 121, sleepers 122 and a track bed 123. The identification-code carriers 103 are preferably designed as transponders.

Figure 4:
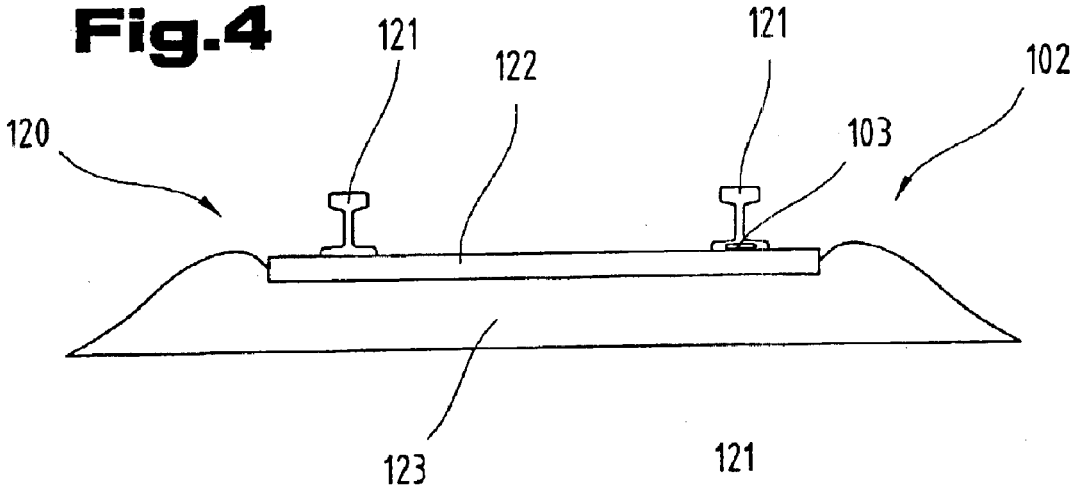
FIG. 4 shows a roadway component with an identification-code carrier permanently installed in a rail.
Figure 5:
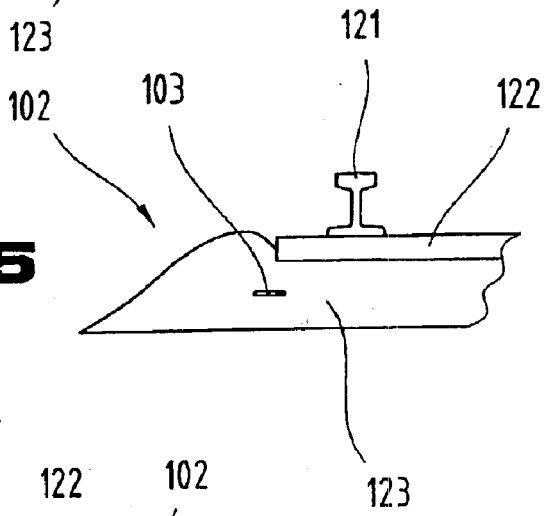
FIG. 5 shows a roadway component with an identification-code carrier installed in the track bed under a rail.
Figure 6:
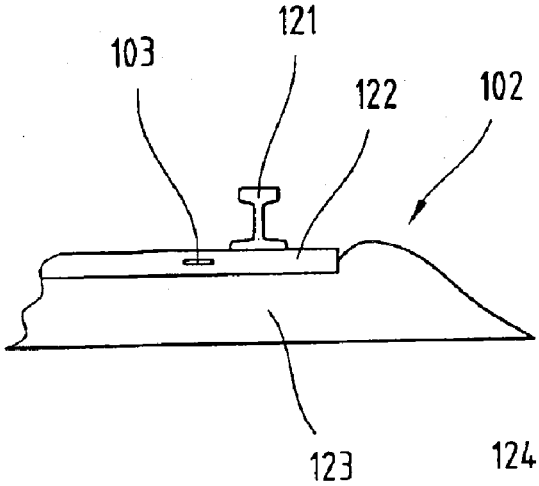
FIG. 6 shows a roadway component with an identification-code carrier installed in a sleeper.
Figure 7:
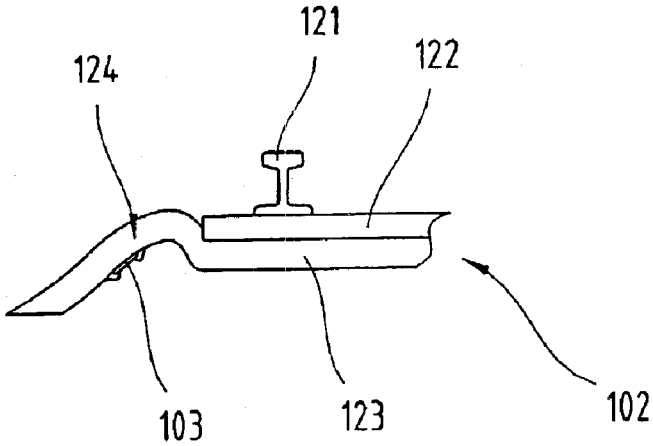
FIG. 7 shows a roadway component with an identification-code carrier fixed to a track bed.

In the exemplary embodiment according to FIG. 4, the identification-code carrier 103 is permanently incorporated into a rail 121. In the exemplary embodiment according to FIG. 5, the identification-code carrier 103 has been injected into the track bed 123. It is likewise possible to incorporate the identification-code carrier 103 into the sleeper 122 (FIG. 6). It is evident that in the exemplary embodiments according to FIGS. 4, 5 and 6 the identification-code carriers 103 can be removed only by destroying the roadway component 102. As shown in FIG. 7, however, it is also possible to attach an identification-code carrier 103 to a track-bed element 123 after the latter has been produced. For this purpose the track-bed element 123 of the roadway component 102 has been provided with an attachment device 124, by means of which the identification-code carrier 103 can be fixed to the substructure of the roadway 102. Fixation may constitute part of the manufacturing process, during production of the roadway component 102, but the identification-code carrier 103 can also be attached later by the user. This enables the user to retrofit the toy individually with identification-code carriers 103.

However, it is of course also possible merely to mount the identification-code carrier 103 on a part that is connected to the roadway component 102, or to attach the identification-code carrier 103 within another part of the toy that is associated with the roadway component 102, for instance a signalling light or traffic sign or similar constituent of the toy.

Figure 8:
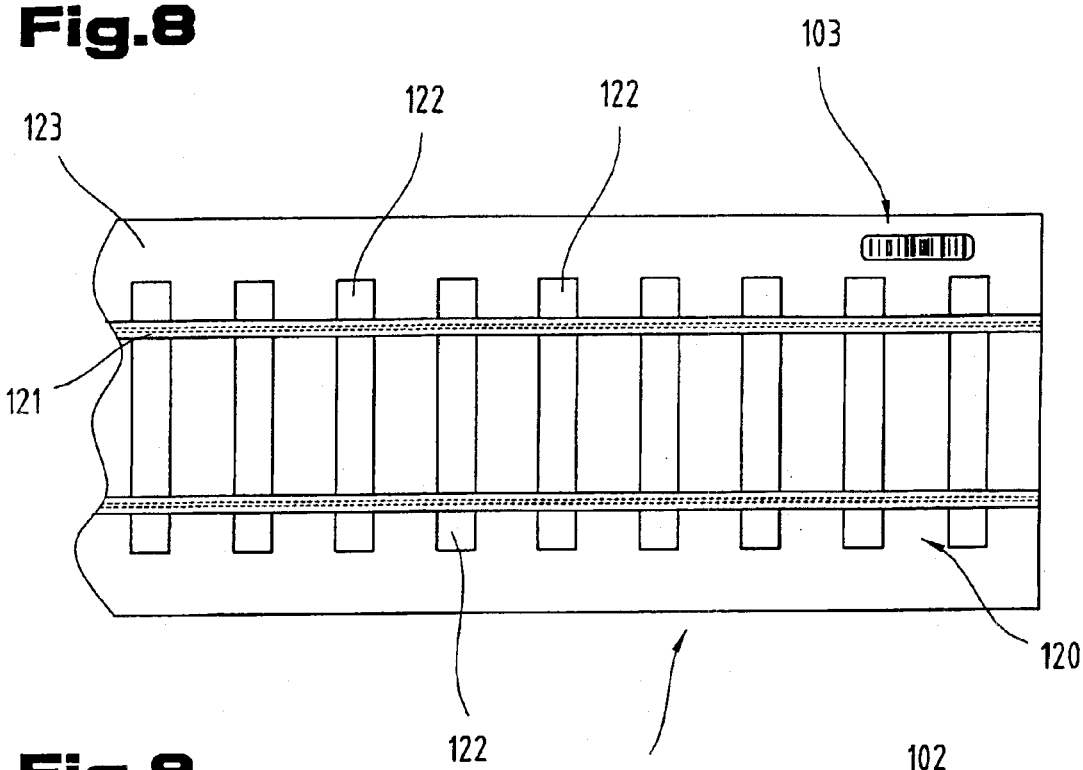
FIG. 8 shows a roadway component with an identification-code carrier in the form of a bar code attached to a track bed.
Figure 9:
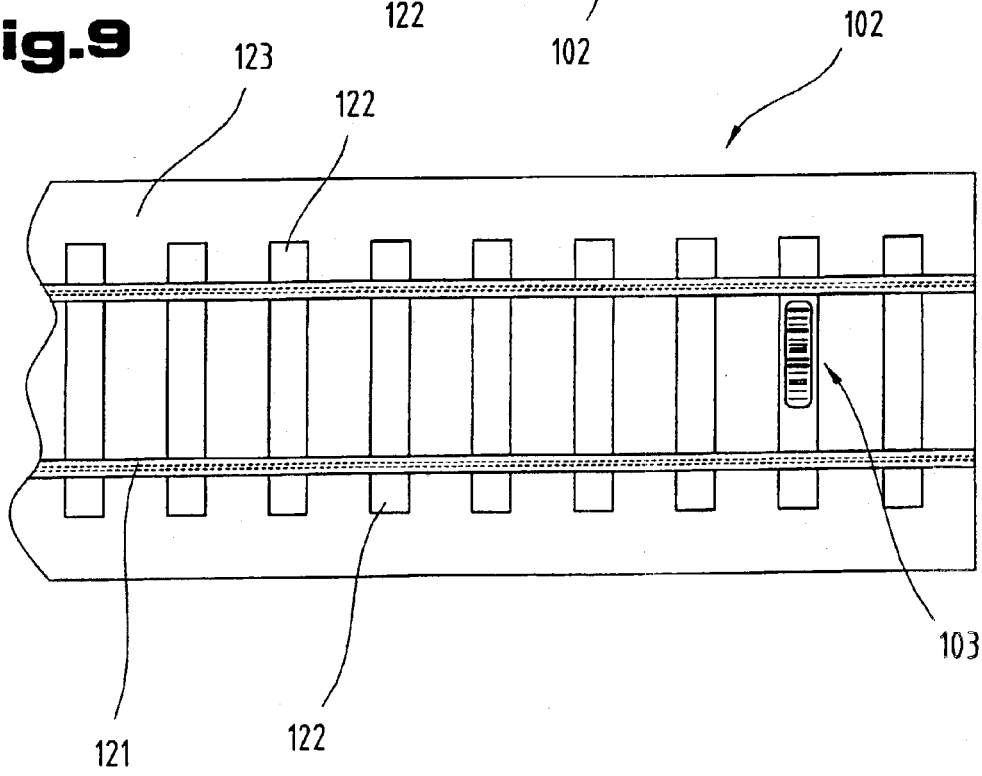
FIG. 9 shows a roadway component with an identification-code carrier in the form of a bar code attached to a sleeper.

FIGS. 8 and 9 show exemplary embodiments of a roadway component 102 in which the identification-code carriers 103 are imprinted with a bar code. In this case the identification-code carrier 103 is attached to the track bed 123 (FIG. 8) or to a sleeper 122 (FIG. 9). So as not to impair the external appearance of the roadway component 102, this bar code is designed so as not to be visible to the human eye; for instance, it may be readable only under UV illumination.

Figure 10:
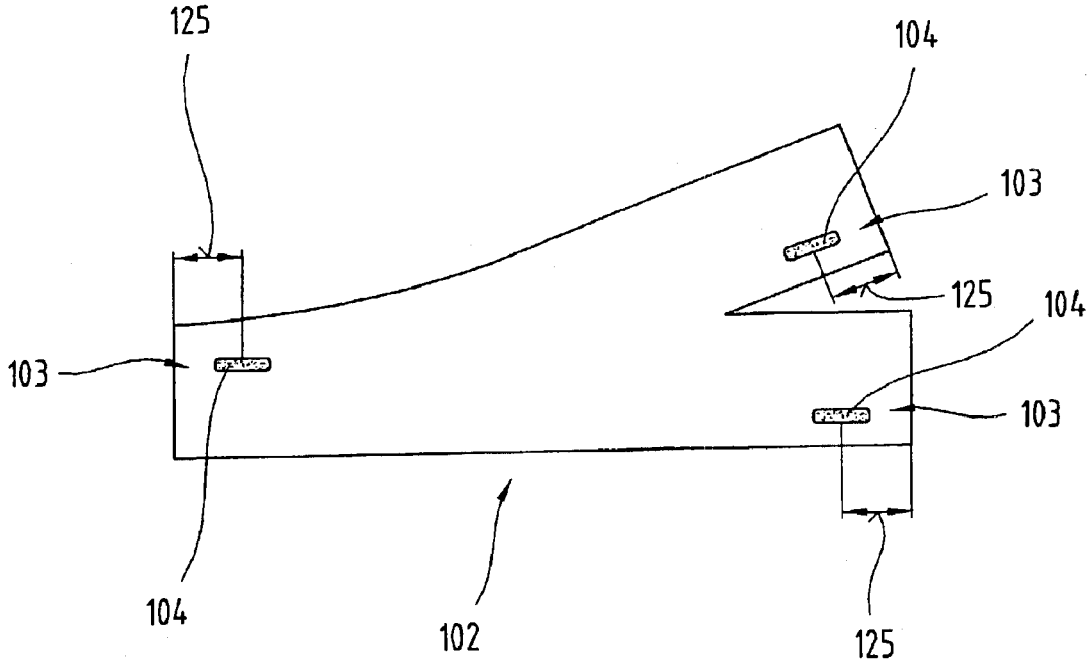
FIG. 10 shows in principle a roadway component constructed as a branch point of a roadway and bearing several identification-code carriers.
Figure 11:
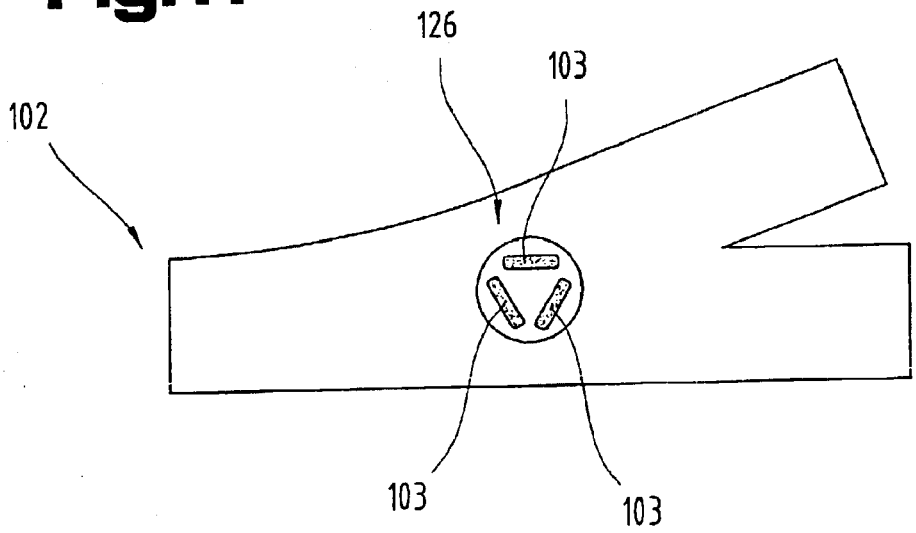
FIG. 11 shows in principle a roadway component constructed as a branch point of a roadway and bearing a carrier for directional identification codes.

FIGS. 10 and 11 represent in simplified form a roadway component 102 used at branch points of the roadway; in model railways, for instance, this would take the form of a switch. On this component multiple identification-code carriers 103 are arranged. In the exemplary embodiment according to FIG. 10 one identification-code carrier 103 is disposed in each of the end regions of the component. Because each of these identification-code carriers 103 bears an individual identifier 104, it is possible for an approaching toy vehicle, by means of the reading device and appropriate evaluation in the evaluation unit in combination with the geometric data for the roadway component 102, to determine the relative spatial position of the roadway component 102.

FIG. 11 shows a branched roadway component with a directional identification-code carrier 126 composed of three identification-code carriers 103. This arrangement of at least three identification-code carriers 103 enables an approaching toy vehicle to determine the relative spatial position of the roadway component 102 on the basis of the transit times of the signals between the reading device and the individual identification-code carriers 103. This calculation requires the geometric data as well as the relative position of the directional identification-code carrier 126 to be stored in the evaluation unit. It is of course also possible to use directional identification-code carriers 126 that are not composed of an arrangement of several identification-code carriers 103 but rather bear identification-code carriers 103 that exhibit a physical feature from which the spatial position can be determined.

In order for the position of the toy vehicle to be determined in the evaluation unit, the latter must have available for each roadway component not only the type-specific geometry data, such as the length, radius, branching angle, branching radius, intersection angle and/or slope angle, but also the relative position of the identification-code carriers 103, in particular distances 125 (FIG. 10) from the end faces of the component. These distances 125, like the geometric data, are uniform for each given type of roadway component.

The components shown in FIGS. 2 and 3 and the arrangements of the identification-code carriers 103 corresponding to FIGS. 4 to 11 enable automatic or semiautomatic control of a toy vehicle 101 that is guided along a roadway by tracks. For this purpose the roadway components 102 (FIGS. 2, 3) are provided with an identification-code carrier 103, the identifier 104 of which specifies at least the type of the roadway component 102, and the toy vehicles 101 are equipped with a reading device 105 for these identification-code carriers 103. As is customary in model building, such a roadway is constructed from different types of components 102. These include, for instance, straight track pieces, switches, intersections and the like. However, this control means is also suitable for toy vehicles guided on a roadway not by tracks, as in the case of a railway, but rather in some other way, for instance by an electronic or ferromagnetic guidance system recessed within the roadway.

Within the scope of the invention it is of course possible to assign the identification-code carriers, in particular a transponder, to a toy vehicle and to dispose a plurality of reading devices on the roadway side. These reading devices are preferably integrated into the roadway components, so as to be in electrically conductive connection with the rails of a constructed track system. The rail network in this track system is used as a two-wire bus, i.e. as a revertive-communication bus to the superordinate evaluation unit. For this purpose control signals can be produced by modulation of the driving voltage applied to the rail system. The essential point here is that the evaluation unit, in particular the personal computer, is in communication with the rails, e.g. by way of an interface card or other adapter device. Preferably the control elements present in a standard model railway, for example so-called locomotive mice, control panels etc., can be used here. These standard control systems can then be used as an accessory or an alternative to the input devices to the evaluation unit, e.g. a conventional keyboard.

When a toy vehicle travels on a newly constructed roadway for the first time, it is possible to obtain a representation of the entire course of the roadway by reading out the type-specific identifiers of the roadway components with the reading device. That is, once the geometrical data and directional information for each type of roadway component have been stored in the evaluation unit, as explained in the description of FIGS. 10 and 11, then by identifying the individual roadway components in sequence, as their identifiers are detected by the traveling vehicle, and associating with each component its type-specific data, a virtual image of the roadway can be generated. When information obtained from the slope measurements made with the slope sensor and from the route distance measurements made with the corresponding measurement device is processed as well, an appropriate computational linking of the data can generate an overall three-dimensional image of the course of the roadway. In this way an individual characterization of the roadway components is present only in the virtual image of the roadway course produced by the evaluation unit. The relevant data can be saved, e.g., in a table in which the individual characterization of a roadway component is associated with the corresponding type-specific identifiers and the component's geometric and/or directional data. This table can also show the other functions associated with particular roadway components. Such functions make it possible to run the toy vehicles in a realistic way by assigning to particular route sections or roadway components specific properties, such as right-of-way or velocity specifications, start/stop commands, braking and/or acceleration tasks and the like.

Because the identifiers of the roadway components are continuously transmitted from the toy vehicle's reading device into the evaluation unit, the momentary position of the vehicle can be established at any time. The prespecified functions simultaneously allow the movements of the toy vehicles on the roadway and/or relative to other toy components to be monitored and influenced. By referring to the virtual diagram in the evaluation unit and determining the position of the toy vehicles it is thus also possible to display an image of the roadway on the monitor of a personal computer. At the same time the functional states of all components and those of the vehicle, as well as the vehicle itself, can be realistically displayed. The assignment of functions to route sections and/or individual roadway components also allows particular signal indications to be specified and/or actions involving the lights of the vehicle to be triggered. Because the control is mediated by a program deposited in the evaluation unit, it is also possible to operate the toy vehicles on the roadway route according to a timetable.

In one possible variant of an embodiment of the invention the identifiers disposed on the roadway components include information about the type of component but do not specify the component individually. In this case if a toy vehicle is taken off the roadway and set onto it again in a completely different place, as often happens, the problem arises that the capabilities of the evaluation unit initially inform it only about the type of roadway component on which the vehicle is seated, but not about the vehicle's current position when on that component. Identification of the actual position within the course of the roadway can be done either semi-automatically or automatically. That is, in the first case the operator can indicate its current position to the vehicle by means of the control program in the personal computer. On the other hand, it is possible to let the vehicle proceed from its initial, unknown position and under program control continuously compare the progressively lengthening sequences of roadway component identifiers with the pattern of component sequences stored in the evaluation unit. The number of possible matches between the new sequence of identified roadway components and individual sections of the known overall route becomes progressively smaller as the length of the new sequence increases, until finally only one possible match remains and the momentary position of the toy vehicle is thereby identified.

In another variant of an embodiment it is also possible to omit the attachment of an identification-code carrier to at least one type of roadway component. This is in any case appropriate for roadway components configured for a straight travel direction. Because all other types are equipped with an identification-code carrier, the momentary position of the toy vehicle can be unequivocally derived from the identifier of the code-equipped component that was last encountered and the distance covered since that encounter, which is measured by the distance-measuring device in the toy vehicle.

For clarity it should mentioned in conclusion that to assist understanding of the construction of the toy, in the drawings it and/or its parts are in some cases shown not to scale and/or enlarged and/or reduced in size.

The independent measures proposed in accordance with the invention to solve problems addressed by its objectives will be evident from the description.

Especially the individual embodiments shown in FIGS. 2; 3; 4, 5, 6, 7; 8, 9; 10, 11 can constitute independent solutions in accordance with the invention. The relevant problems and solutions in accordance with the invention can be discerned in the detailed descriptions of these figures.

Obviously, numerous modifications and variations of the present invention are possible in light of the above teachings. It is therefore to be understood that within the scope of the appended claims, the invention may be practiced otherwise than as specifically described herein.

LIST OF REFERENCE NUMERALS

1 Track
2 Transponder
3 Locomotive
4 Antenna
5 Data-transmission means for revertive communication
6 Receiving device and central memory
7 Monitor
8 Wireless transmission path
101 Toy vehicle
102 Roadway component
103 Identification-code carrier
104 Identifier
105 Reading device
106 Decoder
107 Data-transmission means
108 Transmission path
109 Evaluation unit
110 Monitor
111 Direction sensor
112 Slope sensor
113 Distance-measuring device
120 Track
121 Rail
122 Sleeper
123 Track bed
124 Attachment device
125 Separation distance 126 Directional identification-code carrier

What is claimed is:

1. Method for control of track-guided toys, comprising:

assigning at least one of a type- and geometry-specifying memory component, readable by non-contact, to selected components, the selected components included in a structure of a track system and including the at least one memory component, such that each memory component stores serial identification code, type, geometry and identifying data;

equipping a track-guided toy with a memory-reading device and a data-transmission unit configured for communication;

travelling a route for a first time to generate an electronic representation of a route configuration by reading memory contents from the memory components assigned to the selected components over which the memory-reading device passes;

transmitting the data to and depositing the data in a central memory;

assigning special functions to the selected components to implement operation of the structure;

traveling the route again to determine the momentary position of the track-guided toy by reading the memory components and transmitting the data to the central memory;

independently monitoring and controlling one or more of the track-guided toys on the basis of prescribed tasks associated with operation of the structure, taking into account route and velocity information and the special functions.

2. Method according to claim 1, wherein, at least during the first time travelling around the route, changes in direction are detected by a sensor and transmitted as part of the data.

3. Method according to claim 1, wherein, at least during the first time travelling around the route, changes in vertical position of the route are detected by a slope sensor and transmitted as part of the data.

4. Method according to claim 1, wherein position and velocity data is compared with expected data according to the route configuration stored in the central memory, such that a discrepancy due to damage or a change in a direction of travel can be detected.

5. Method according to claim 1, wherein depending on at least one of a route section being currently traveled or passed, and depending on a special function associated with the route section currently traveled or passed, at specified points prescribed actions are triggered.

6. Method according to claim 5, wherein when a route track section with a specified signal indication has been reached, a light in the track-guided toy is activated.

7. Method according to claim 1, wherein on a monitor a route diagram and relevant functional states are displayed for an identified track-guided toy.

8. Method according to claim 1, wherein by detecting the route and track-guided toy positions, a timetable operation is implemented.

9. Method according to claim 1, wherein the data is transmitted via a standard bus or by a wireless transmission path.

10. A selected component for use with a method according to claim 1, including a transponder, in which the at least one of the type and geometric data relevant to the selected component are stored, along with an individual identification code.

11. The selected component according to claim 10, wherein the selected component is a track and the transponder is incorporated into or connected to a track ballast or track bed so that the transponder cannot be removed without destroying the track ballast or track bed.

12. The selected component according to claim 10, wherein the individual identification code is a sequence of numeric or alphanumeric symbols that is not repeated within a series of such codes.

13. The selected component according to claim 10, wherein the selected component is a track and the geometric data comprises at least one of a track length, a track radius, a branching angle, a branching radius, an intersection angle, a radius of a trunk and branch tracks of a track section.

14. A track-guided toy for use with a method according to claim 1, including a unit configured to activate and scan transponder contents, a decoder, and a data-transmission unit configured to transmit the scanned items of information and/or data.

15. The track-guided toy according to claim 14, wherein the data-transmission unit is connected to the decoder, to which scanned transponder contents are sent and the data-transmission unit includes a hard-wired or wireless interface.

16. The track-guided toy according to claim 14, wherein a sensor detects changes in movement of the track-guided toy in at least one of vertical and horizontal directions.

17. The track system according to claim 10, wherein the transponder comprises a transmitting and receiving antenna, control logic, and storage means for data and energy, such that an electrical operating energy is taken from an electromagnetic field encountered when the transponder is within a range of radiation from the transmitter antenna.

18. A system for control of track-guided toys, comprising:

at least one memory component readable by non-contact, disposed in or at selected components of a track system, and that contains stored information specifying a type of associated structure and a unique individual identification code;

at least one memory-reading device in a track-guided toy that comprises a data-transmission unit configured to communicate contents acquired while travelling over or reaching the at least one memory component; and a superordinate central control and memory unit configured to determine a position and velocity of the track-guided toy.

19. Method of controlling a toy with at least one track-guided toy configured to be driven along a roadway comprising:

(a) assigning at least one identification-code carrier, which can be read by non-contact and includes an unmistakable identifier, to at least one of the toy components;

(b) assigning at least one reading device for the identification-code carrier;

(c) constructing a data-transmission unit between the reading device and an evaluation unit;

(d) moving the track-guided toy along a roadway such that there is relative movement between the at least one reading device and the at least one identification-code carrier;

(e) detecting the identifier in each identification-code carrier and transmitting the identifier to the evaluation unit;

(f) correlating functions and type-specifying data with each individual identifier;

(g) determining a momentary position of each of the toy components that are movable relative to one another, such that with reference to prescribed functions at least the movement of one toy component with respect to other toy components is monitored and influenced.

20. Method according to claim 19, further comprising:

moving the track-guided toy along the roadway, during which the identification-code carrier and reading device move relative to one another; and recording of the identifier in each identification-code carrier as each identification-code carrier moves past the reading device.

21. Method according to claim 19, further comprising:

detecting and measuring distances covered by the track-guided toy as the toy vehicle passes along the roadway, and transmitting signals or values detected or measured to the evaluation unit.

22. Method according to claim 19, further comprising:

displaying, at least symbolically, the roadway representation and various functional states of the track-guided toy vehicle.

23. Method according to claim 22, wherein a display representing at least the track-guided toy corresponds to reality.

24. Method according to claim 19, wherein when a section of the route with a specified signal indication is reached, an action of the track-guided toy is initiated.

25. Method according to claim 19, wherein based on determination of the position of the track-guided toy operation is controlled by a timetable.

26. A roadway component for track-guided toy vehicles, controlled according to the method of claim 19, including an identification-code carrier with an identifier from which at least the type data for the roadway component can be derived, or by which the type is unambiguously defined.

27. The roadway component according to claim 26, wherein the identification-code carrier is connected to a toy component associated with a roadway component.

28. The roadway component according to claim 26, wherein the identification-code carrier cannot be removed without destroying the roadway component.

29. The roadway component according to claim 26, wherein a position of the identification-code carrier relative to the roadway component, and a distance separating the identification-code carrier from end faces of the roadway component, is uniform for a specific type.

30. The roadway component according to claim 26, wherein the identifier for a type of roadway component is encoded by a sequence of numeric or alphanumeric symbols.

31. The roadway component according to claim 26, wherein the identifiers are associated with geometric data including at least one of lengths, radii, branching angles, branching radii, intersection angles, and slope angles of track sections of a track system.

32. The roadway component according to claim 26, wherein the identifier for a type of roadway component is at least one of an electrically and magnetically detectable feature.

33. The roadway component according to claim 26, wherein the identification-code carrier comprises a transmitting and receiving antenna, control logic, and means for storing data and energy, such that the electrical operating energy is taken from an electromagnetic field when the identification-code carrier is within a range of emitted radiation from a reading device.

34. The roadway component according to claim 26, wherein the identifier for a type of roadway component includes an optically detectable feature.

35. The roadway component according to claim 26, wherein the type-specific identifier of a roadway component includes a feature detectable by ultrasound sampling.

36. The roadway component according to claim 26, wherein at each of at least two ends spaced apart from one another, an identification-code carrier with an identifier that identifies the ends is disposed.

37. The roadway component according to claim 26, including a directional identification-code carrier from which a spatial position of the toy component can be detected.

38. A toy vehicle for use with a method according to claim 19, wherein the toy vehicle comprises a reading device configured to detect identifiers associated with roadway components and a data-transmission unit configured to transmit the detected information and data.

39. The toy vehicle according to claim 38, wherein the reading device has a limited spatial range for reading the identification-code carriers.

40. The toy vehicle according to claim 38, wherein the reading device is designed with a spatial range for reading the identification-code carriers that is between 0 mm and 50 mm.

41. The toy vehicle according to claim 38, wherein when the toy-vehicle is set onto rails of a track system, the data-transmission means unit is in electrically conductive communication with the track system.

42. The toy vehicle according to claim 38, wherein the data-transmission means is connected to or comprises a decoder, configured as a coding/decoding circuit or a modulator/demodulator circuit, such that the data-transmission unit is connected to sliding contacts to form a hard-wired transmission path, or with an antenna to form a wireless transmission path.

43. The toy vehicle according to claim 38, wherein the toy vehicle includes a sensor to detect the movements of the toy vehicle in at least one of vertical and horizontal directions.

44. The toy vehicle according to claim 38, wherein the toy vehicle includes a slope sensor.

45. The toy vehicle according to claim 38, wherein the toy vehicle includes a device configured to measure a distance along the route.

46. Method of determining a position of a track-guided toy and obtaining information about a course of a roadway, comprising:

(a) assigning at least one identification-code carrier, which can be read by non-contact and includes an identifier of at least one of the toy components;

(b) assigning at least one reading device for the identification-code carrier;

(c) constructing a data-transmission means between the reading device and an evaluation unit;

(d) moving the track-guided toy along a roadway such that there is relative movement between the at least one reading device and the at least one identification-code carrier;

(e) detecting the identifier in each identification-code carrier and transmitting each identifier to the evaluation unit;

(f) correlating functions and type-specifying data with each individual identifier;

(g) producing or calculating a representation of the roadway that corresponds to at least one of the detected identifiers, the relative position of the track-guided toy; and (h) displaying at least the roadway representation and the relative position of the track-guided toy on an output device belonging to the evaluation unit.

47. A system for control of track-guided toys, comprising:

at least one identification-code carrier that can be read by non-contact and is disposed on a toy component, such that the identifier in the identification-code carrier specifies a type of an associated toy component;

at least one reading device in a toy component, which includes or is connected to a data-transmission unit configured to communicate contents detected while traveling over or reaching the identification-code carrier; and a superordinate central evaluation unit configured to determine at least one of a the position and a velocity of the track-guided toy relative to a roadway.

48. A system for electronically operated track-guided toys, comprising:

at least one identification-code carrier configured to be read by non-contact means and disposed in roadway components with an exception of roadway components that are constructed for a straight direction of travel, such that an identifier in the identification-code carrier specifies a type of associated roadway component;

at least one reading device for detecting the identifier in the identification-code carrier in the track-guided toy, at least one distance-measuring device in the track-guided toy;

a data-transmission unit in the track-guided toy to communicate the detected identifiers and distance measurements; and a superordinate central evaluation unit configured to determine a position and velocity of the track-guided toy.

* * * * *